US012797700B2

(12) United States Patent
Skiver

(10) Patent No.: US 12,797,700 B2
(45) Date of Patent: Nov. 17, 2026

(54) GEOGRAPHICAL MARKER SYSTEM

(71) Applicant: SKIVER and CROW LLC, Scottsdale, AZ (US)

(72) Inventor: Dutch Skiver, Phoenix, AZ (US)

( * ) Notice: Subject to any disclaimer, the term of this patent is extended or adjusted under 35 U.S.C. 154(b) by 956 days.

(21) Appl. No.: 17/513,813

(22) Filed: Oct. 28, 2021

(65) Prior Publication Data

US 2023/0138628 A1 May 4, 2023

(51) Int. Cl.
*A63B 57/30* (2015.01)

(52) U.S. Cl.
CPC ..... *A63B 57/30* (2015.10); *A63B 2220/12* (2013.01); *A63B 2225/15* (2013.01); *A63B 2225/54* (2013.01)

(58) Field of Classification Search
CPC ..... A63B 57/30; A63B 2220/12
See application file for complete search history.

(56) References Cited

U.S. PATENT DOCUMENTS 5,593,156 A 1/1997 Jambor
6,463,703 B1 10/2002 Mattis
7,479,067 B2 1/2009 Gibson
9,809,992 B1 * 11/2017 Barlow ..... E04H 12/00
2002/0035959 A1 * 3/2002 Bukky ..... G09F 3/12 52/103
2002/0196633 A1 * 12/2002 Huang ..... F21V 21/06 362/431
2005/0052951 A1 * 3/2005 Ray ..... G01V 1/3808 367/188
2013/0318844 A1 * 12/2013 Duhaime Ohnstad ..... G09F 15/0081 40/607.01
2014/0126329 A1 * 5/2014 Guyton ..... G01V 1/18 367/76
2015/0043310 A1 * 2/2015 Maas ..... G01V 1/162 29/601
2020/0342793 A1 * 10/2020 Patterson ..... G09F 13/0413
2021/0080600 A1 * 3/2021 Bernard ..... G01V 1/162

* cited by examiner

*Primary Examiner* — Joseph B Baldori
*Assistant Examiner* — Christopher Glenn
(74) *Attorney, Agent, or Firm* — Accelerate IP LLC

(57) ABSTRACT

An apparatus with an electronic communications subsystem. The apparatus includes an elongated vertical housing that snap-fits to a base plate having a cruciform spike there under. At least one side of the housing is configured to receive engravable snap-fit panel inserts bearing text and/or images. The interior of the housing has a cruciform support. The cylindrical container may be used for a variety of purposes, such as a time capsule, trinkets, emergency supplies, etc. The electronic communications subsystem may be provided on the exterior of the housing or snap-fit panel insert in the form of QR codes or URLs. The electronic communications subsystem may be inside the housing in the form of passive or active electronic chips that can be interrogated by a custom application loaded on a smart phone.

20 Claims, 9 Drawing Sheets

GEOGRAPHICAL MARKER SYSTEM

FIELD OF ART

The present invention relates to a device for marking a boundary. The present invention more particularly relates to geographical marker systems with external markings, a storage capsule inside, and electronic means of communication with persons in proximity.

BACKGROUND OF THE INVENTION

Some geographical features, such as golf courses, require geographical marker systems to indicate where a golfer has hit a ball out of bounds. Such markers may be typically mundane purely functional items.

SUMMARY OF THE INVENTION

Briefly described, the invention provides an apparatus and an electronic communications subsystem. In a preferred embodiment, the apparatus includes an elongated vertical housing of rectangular cross section that snap-fits to a flat square base plate having a cruciform spike extending from the underside of the base plate for securing the geographical marker system to the ground. Three of the four sides of the housing are configured to receive snap-fit panel inserts bearing text and/or images. The sides of the housing may support snap fit panels bearing a trademark, logo, or other visual messages. A truncated pyramidal cap sits atop the housing. The interior of the housing has a cruciform support just above the base plate for structural stability and for supporting a cylindrical container within the housing. The cap includes internal cross bars for structural stability. The cylindrical container may be used for a variety of purposes, such as a time capsule, trinkets, emergency supplies, etc. In a preferred embodiment, the apparatus includes means for enabling electronic communication. The electronic communications subsystem may be provided on the exterior of the housing or snap-fit panel insert in the form of QR codes or URLs that may be used by smart phones to access web pages with further information and that may receive communication from the smart phone user. The electronic communications subsystem may be provided inside the housing, including inside the cylindrical container cap, in the form of passive electronic chips, such as (without limitation) RFID chips that can be interrogated by a custom application loaded on a smart phone. The electronic communications subsystem may be provided inside the housing in the form of active electronic chips that emit signals that can be received by a custom application on a smartphone.

Uses for the invention include, without limitation, boundary markers on golf courses, trail markers, memorials, geocaching with electronic logbooks, private property boundary markers, tributes, tour markers, cross country markers, and the like. The housing and snap-fit panel inserts may be colored as appropriate for a particular use. For example, in various embodiments camouflage, bright primary colors, heraldry or emblematic colors, and the like may suffice.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used and defined herein, the term "cylindrical" refers to cylinders of any cross section, including polygons, conic sections, and irregular cross sections. As used and defined herein, the terms "top", bottom", "side", and other terms of orientation, refer to the geographical marker 100 in its operational orientation, as shown in FIG. 1A.

Figure 1A:
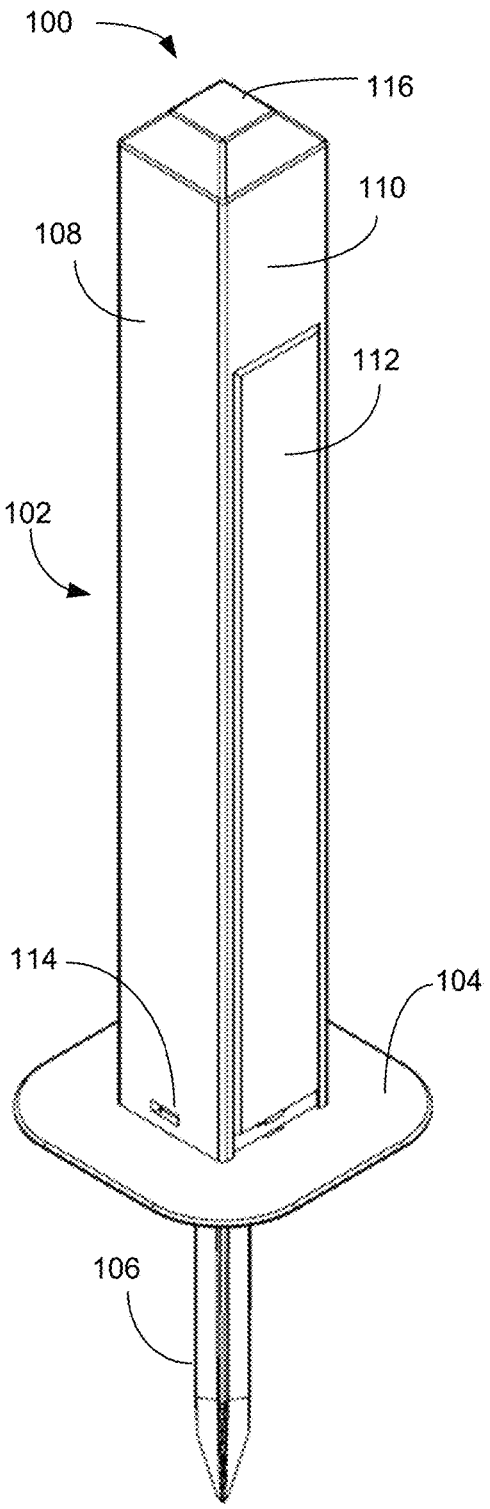
FIG. 1A is a perspective view illustrating an exemplary embodiment of a geographical marker system, according to a preferred embodiment of the present invention.

FIG. 1A is a perspective view illustrating an exemplary embodiment of a geographical marker system 100, according to a preferred embodiment of the present invention. Housing 102 is exemplified as a cylinder having a square cross section. In various other embodiments, various respective cross-sectional shapes may be used including, without limitation, regular and irregular polygonal shapes, conic section shapes, and irregular shapes. Preferably, housing 102 is made from a material that is transparent to radio frequencies. In a particular embodiment, housing 102 may be tapered upwardly. Housing 102 is supported by base plate 104 and is connected to base plate 104 by snap fittings 114 (one labeled of two visible of four snap fittings). Baseplate 104 has a cruciform spike 106 extending downwardly from the underside surface 124 of baseplate 104. The spike 106 is used to secure the geographical marker system 100 to the ground.

Housing 102 has a rear side 108, which is plain except for a snap fitting 114, and a left-hand side 110 which contains a snap-in panel 112. The snap-in panel 112 is preferably decorated via engraving, embossment, painting, or other visible means to display names, messages, snarky comments, memorials, etc. The top portion of left-hand side 110 preferably has a trademark, logo, or other identifying information displayed thereon. A truncated pyramidal cap 116 closes off the top of the housing 102. In some embodiments, the cap 116 may not be truncated.

Figure 1B:
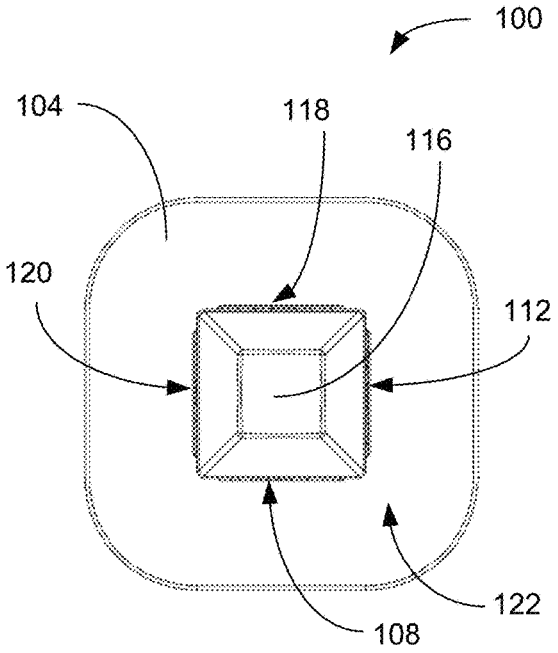
FIG. 1B is a top plan view illustrating the exemplary embodiment of the geographical marker system of FIG. 1A, according to a preferred embodiment of the present invention.

FIG. 1B is a top plan view illustrating the exemplary embodiment of the geographical marker system 100 of FIG. 1A, according to a preferred embodiment of the present invention. Plain rear side 108 is shown along with left side snap-in panel 112, front snap-in panel 118, and righthand side snap in panel 118. The top surface 122 of baseplate 104 may be free of decoration.

Figure 1C:
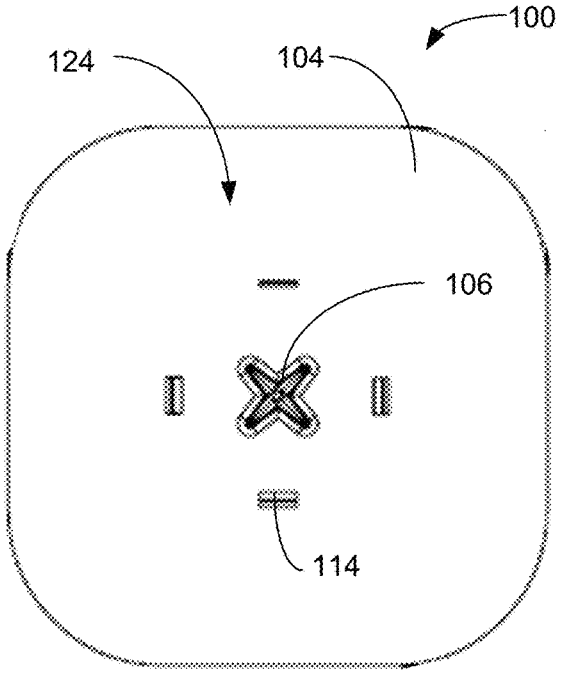
FIG. 1C is a bottom plan view illustrating the exemplary embodiment of the geographical marker system of FIG. 1A, according to a preferred embodiment of the present invention.

FIG. 1C is a bottom plan view illustrating the exemplary embodiment of the geographical marker system 100 of FIG. 1A, according to a preferred embodiment of the present invention. Cruciform spike 106 extends from the bottom surface 124 of baseplate 104. Bottom portion of snap fittings 114 (one of four labeled) can be seen.

Figures 2A, 2B, 2C:
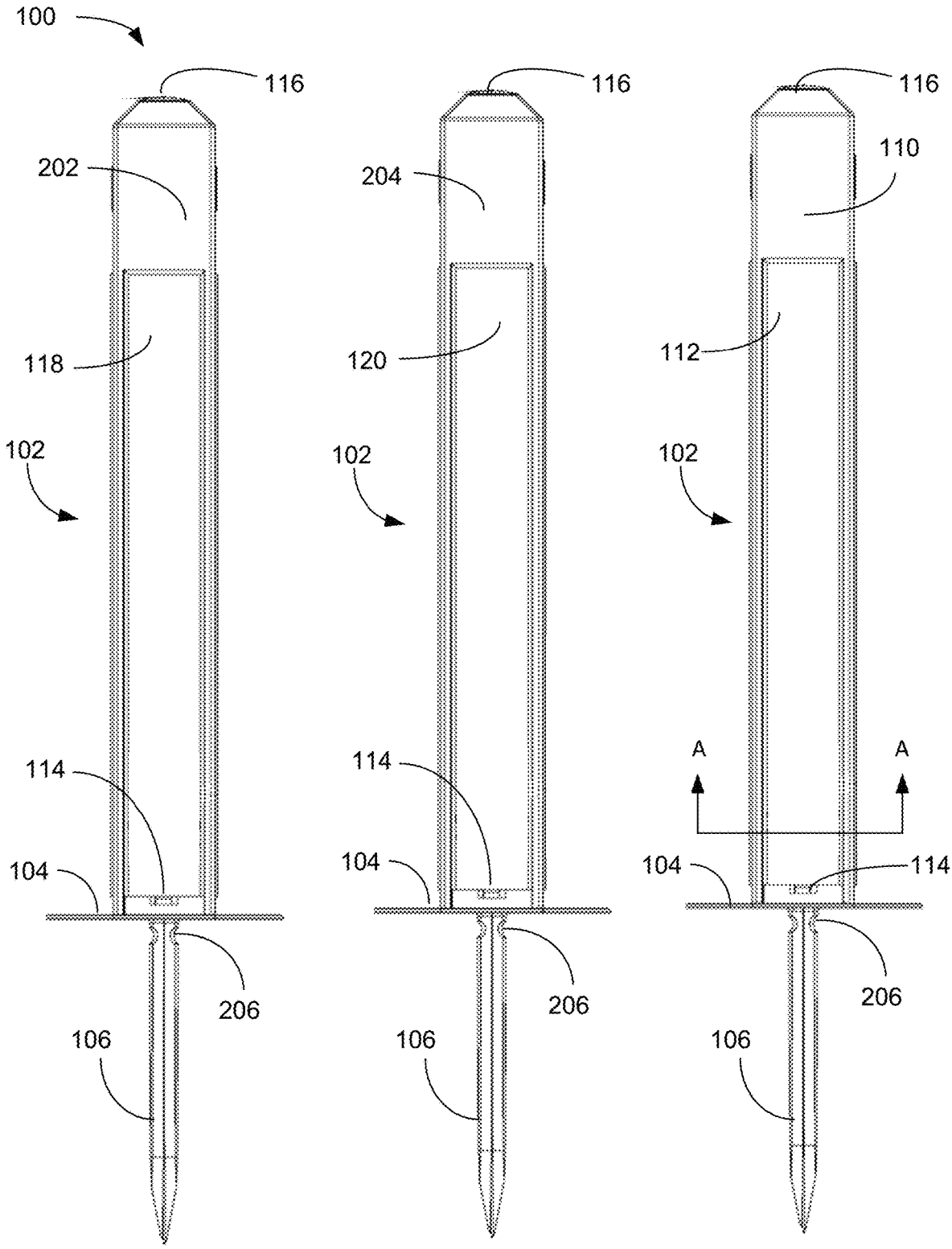
FIG. 2A is a side elevation view illustrating the exemplary embodiment of the front side of the geographical marker system of FIG. 1A, according to a preferred embodiment of the present invention.
FIG. 2B is a side elevation view illustrating the exemplary embodiment of the left-hand side of the geographical marker system of FIG. 1A, according to a preferred embodiment of the present invention.
FIG. 2C is a side elevation view illustrating the exemplary embodiment of the left-hand side of the geographical marker system of FIG. 1A and defining cross section AA, according to a preferred embodiment of the present invention.

FIG. 2A is a side elevation view illustrating the exemplary embodiment of the front side 202 of the geographical marker system 100 of FIG. 1A, according to a preferred embodiment of the present invention. Front side 202 preferably supports decoration, a snap fitting 114, and a snap-in panel 118. Snap-in panel 118 is similar in purpose to snap-in panel 112. Spike 106 is shown to have a narrow break-away section 206 to facilitate removal from the ground. In some embodiments, spike 106 may be releasably attached to base plate 104, making removal even easier.

FIG. 2B is a side elevation view illustrating the exemplary embodiment of the righthand side 204 of the geographical marker system 100 of FIG. 1A, according to a preferred embodiment of the present invention. Righthand side 204 preferably supports decoration, a snap fitting 114, and a snap-in panel 120. Snap-in panel 120 is similar in purpose to snap-in panel 112.

FIG. 2C is a side elevation view illustrating the exemplary embodiment of the left-hand side 110 of the geographical marker system of FIG. 1A and defining cross section AA, according to a preferred embodiment of the present invention. Left side 110 preferably supports decoration, a snap fitting 114, and a snap-in panel 112, as described above. Section AA is an upward-looking view showing the interior of the geographical marker system 100 in FIG. 2E.

Figure 2D:
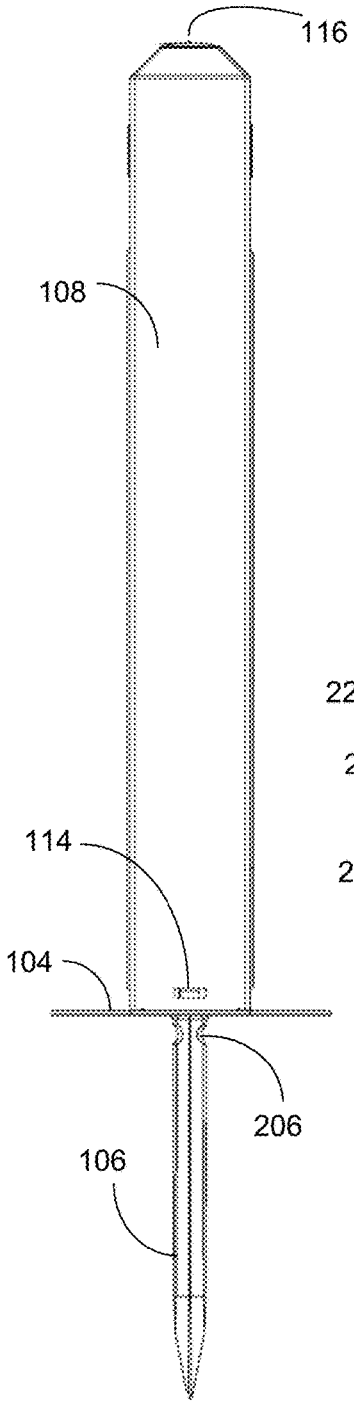
FIG. 2D is a side elevation view illustrating the exemplary embodiment of the rear side of the geographical marker system of FIG. 1A, according to a preferred embodiment of the present invention.

FIG. 2D is a side elevation view illustrating the exemplary embodiment of the rear side 108 of the geographical marker system 100 of FIG. 1A, according to a preferred embodiment of the present invention. Rear side 108 may, in some embodiments, be decorated. For example, when used on a golf course, the entire housing 102 may have a green background color. For further example, in a geocaching marker, it may have a camouflage coloration over all.

Figure 2E:
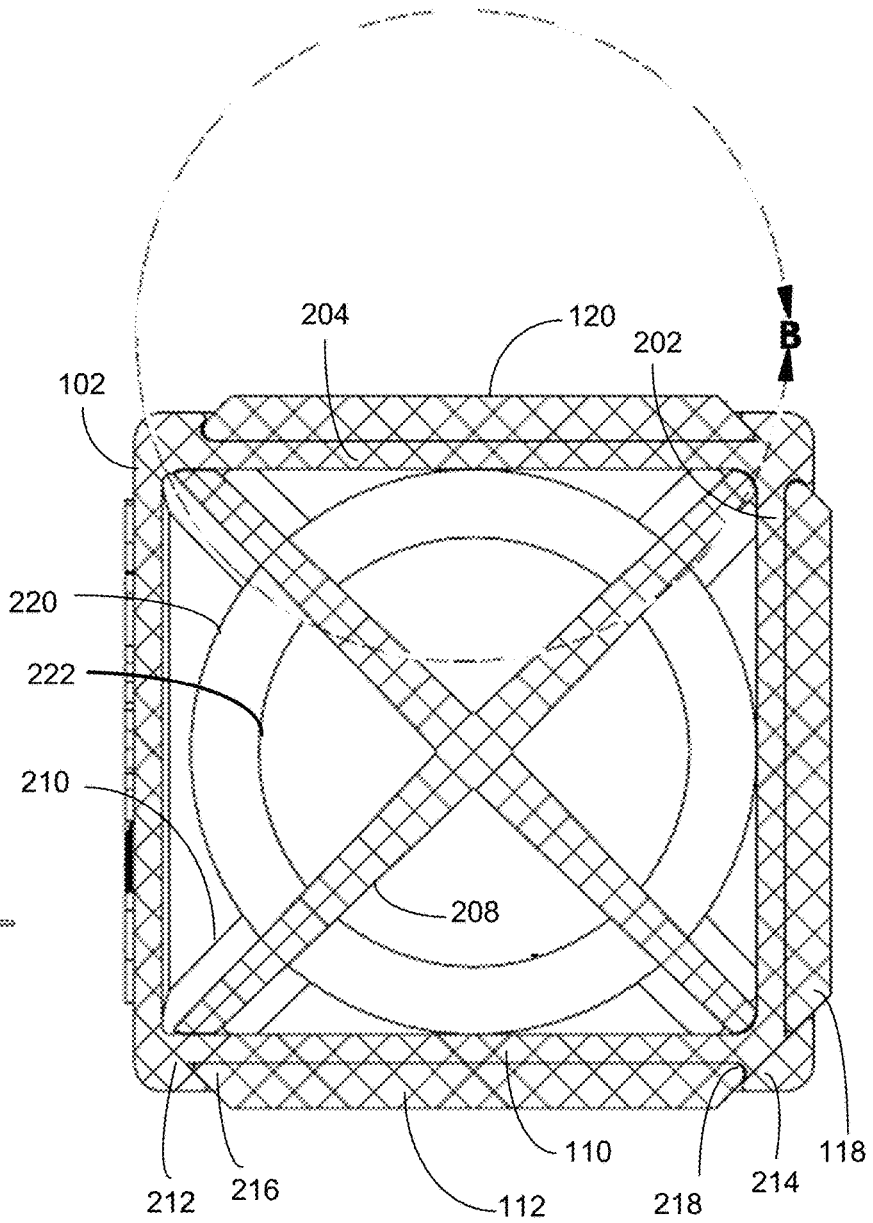
FIG. 2E is a cross section view illustrating the cross section AA of the exemplary embodiment of the geographical marker system of FIG. 1A and defining section B, according to a preferred embodiment of the present invention.

FIG. 2E is a cross section view illustrating the crosssection AA of the exemplary embodiment of the geographical marker system 100 of FIG. 1A and defining section B, according to a preferred embodiment of the present invention. Housing 102 supports snap-in panels 112, 118, and 120 on sides 110, 202, and 204, respectively. Snap-in panel 112, for example, has an acutely angled edge 216 and an opposing rounded edge 218, Acutely angled edge is initially inserted into acutely angled cavity 212. The rounded edge 218 is then snapped into round cavity 214 to secure the panel 112 to the side 110. Cruciform support 208 rests on baseplate 104 and supports cylindrical container 220 on its bottom flat side 222. Upper cruciform support 210 is part of the cap 116, thereby assisting in the structural stability of the housing 102 and securing the cylindrical container 220 in place.

Figure 2F:
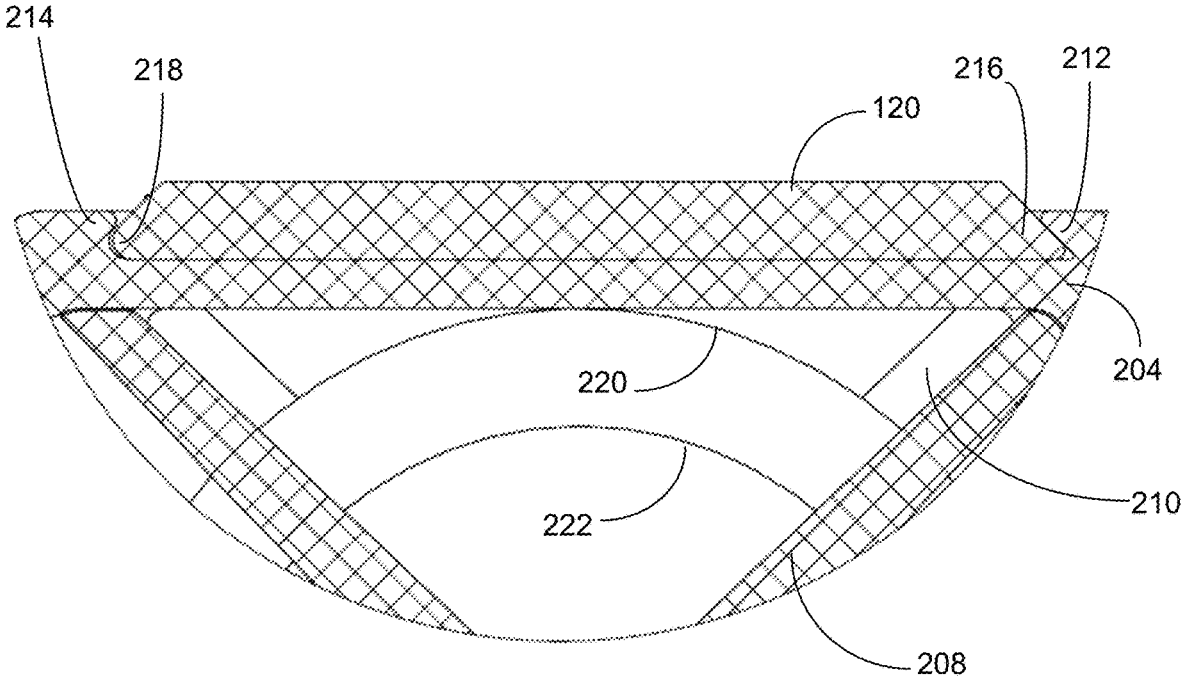
FIG. 2F is a cross section view illustrating the section B of the exemplary embodiment geographical marker system of FIG. 1A, according to a preferred embodiment of the present invention.

FIG. 2F is a cross section view illustrating the section B of the exemplary embodiment geographical marker system 100 of FIG. 1A, according to a preferred embodiment of the present invention. The acutely angled edge 216 and cavity 212 can be seen in more detail, as can rounded edge 218 and rounded cavity 214.

Figure 3A:
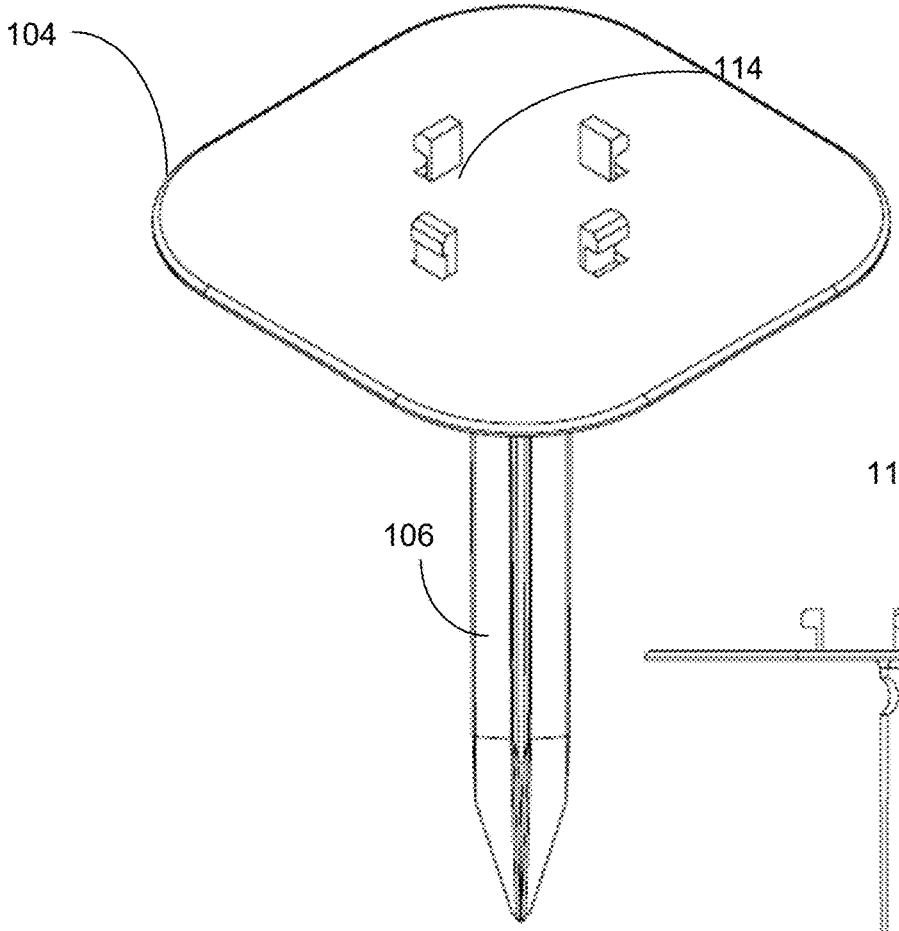
FIG. 3A is a perspective view illustrating a baseplate of the exemplary embodiment of the geographical marker system of FIG. 1A, according to a preferred embodiment of the present invention.

FIG. 3A is a perspective view illustrating a baseplate 104 of the exemplary embodiment of the geographical marker system 100 of FIG. 1A, according to a preferred embodiment of the present invention. Snap fittings 114 (one of four labeled) can best be seen in this view. In some embodiments, other types of fasteners may be used. For example, screw or bolt fittings may substitute for snap fittings 114. In some embodiments, the spike 106 may be tapered.

Figure 3B:
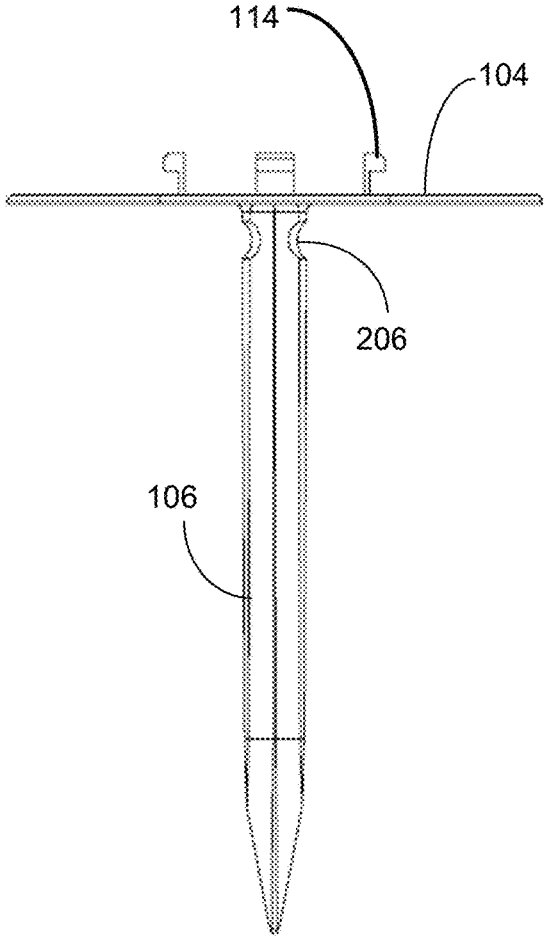
FIG. 3B is a side elevation view illustrating the baseplate of the exemplary embodiment of the geographical marker system of FIG. 1A, according to a preferred embodiment of the present invention.

FIG. 3B is a side elevation view illustrating the baseplate 104 of the exemplary embodiment of the geographical marker system 100 of FIG. 1A, according to a preferred embodiment of the present invention. Snap fittings 114 are preferably made of resilient plastic, whereas the baseplate 104 is preferably made of steel. In some embodiments, baseplate 104 may be made of hard plastic, composite, or other materials of similar hardness and weather resistance.

Figure 4A:
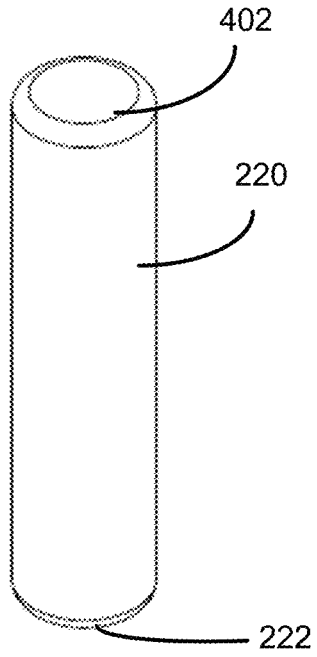
FIG. 4A is a perspective view illustrating a first exemplary embodiment of a cylindrical container of the exemplary embodiment of the geographical marker system of FIG. 1, according to a preferred embodiment of the present invention.

FIG. 4A is a perspective view illustrating a first exemplary embodiment of a cylindrical container 220 of the exemplary embodiment of the geographical marker system 100 of FIG. 1A, according to a preferred embodiment of the present invention. Cylindrical container 220 has a snap-fit, zero-relief snap-in cap 402.

Figure 4B:
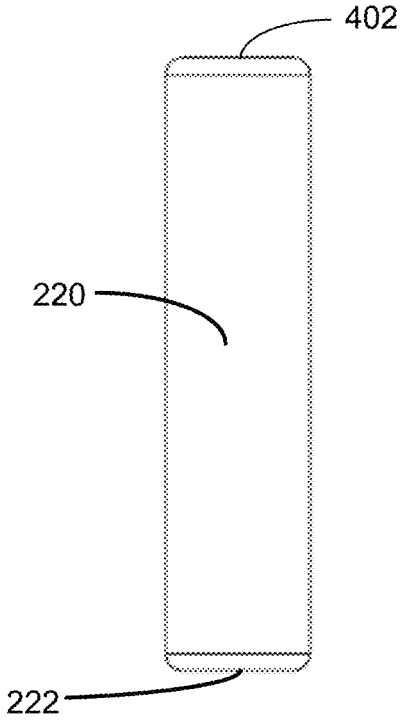
FIG. 4B is a side elevation view illustrating the first exemplary embodiment of a cylindrical container of the exemplary embodiment of the geographical marker system of FIG. 1, according to a preferred embodiment of the present invention.

FIG. 4B is a side elevation view illustrating the first exemplary embodiment of the cylindrical container 220 of the exemplary embodiment of the geographical marker system 100 of FIG. 1A, according to a preferred embodiment of the present invention. Cylindrical container 220 preferably has no radial extensions. In various other embodiments, respective other various cylindrical cross sections may suffice. For example and without limitation, cylinders having regular or irregular polygonal cross sectional shapes, conic section cross sectional shapes, and irregular shapes may be used.

Figure 4C:
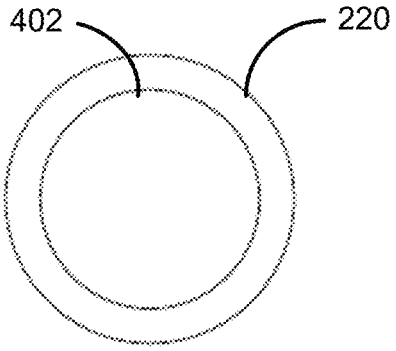
FIG. 4C is a bottom plan view illustrating the first exemplary embodiment of the cylindrical container of the geographical marker system of FIG. 1, according to a preferred embodiment of the present invention.

FIG. 4C is a bottom plan view illustrating the first exemplary embodiment of the cylindrical container 220 of the geographical marker system 100 of FIG. 1A, according to a preferred embodiment of the present invention. The cap 402 is not meant to be easily removed by hand.

Figure 5D:
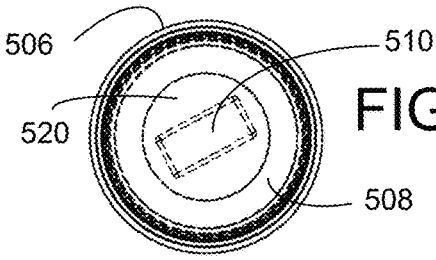
FIG. 5D is a top wire frame view illustrating the second exemplary embodiment of the cylindrical container of the exemplary embodiment of the geographical marker system of FIG. 1A, according to a preferred embodiment of the present invention.
Figure 5B:
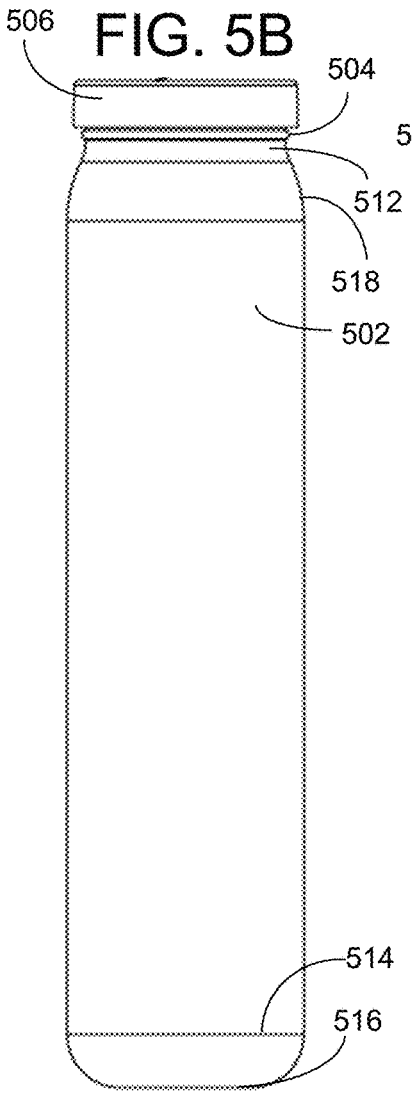
FIG. 5B is a side elevation view illustrating the second exemplary embodiment of the cylindrical container of the exemplary embodiment of the geographical marker system of FIG. 1A, according to a preferred embodiment of the present invention.
Figure 5A:
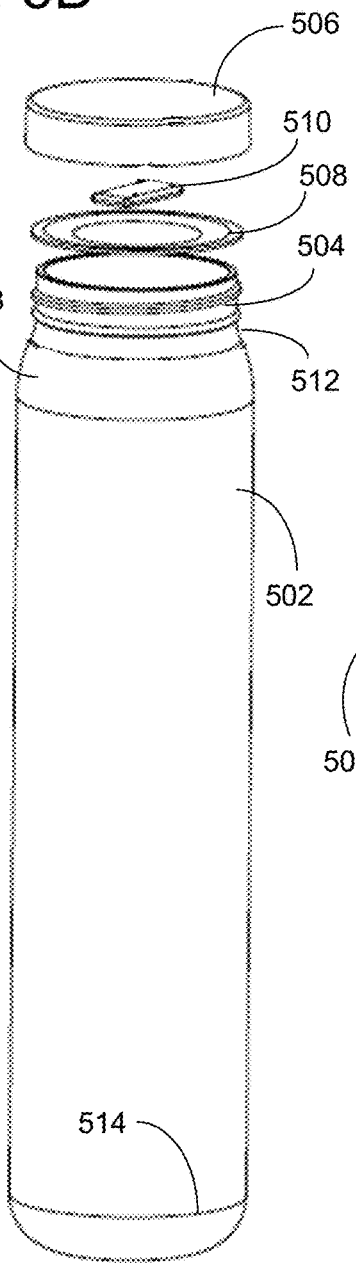
FIG. 5A is an exploded perspective view illustrating a second exemplary embodiment of a cylindrical container of the exemplary embodiment of the geographical marker system of FIG. 1A, according to a preferred embodiment of the present invention.

FIG. 5A is an exploded perspective view illustrating a second exemplary embodiment of a cylindrical container 502 of the exemplary embodiment of the geographical marker system 100 of FIG. 1A, according to a preferred embodiment of the present invention. Cylindrical container 502 has a shoulder 518, a neck 512, a threaded closure 504, a seal 508, a threaded cap 506, and a passive communication chip 510, such as an RFID chip 510 secured between the seal 508 and the cap 506. Cylindrical container 502 has a rounded bottom edge 514. The passive communication chip 510 runs off antenna-gathered energy from an outside interrogating source such as a cell phone. The passive communication chip 510 can provide the interrogator with information such as a name, a URL, contact information, etc. In some embodiments, other communication strategies may be used, including active communication chips, QR codes or URLs on the snap-in panels 112, 118, and 120; housing sides 108, 110, 202, and 204; or cap 116, etc.

FIG. 5B is a side elevation view illustrating the second exemplary embodiment of the cylindrical container 502 of the exemplary embodiment of the geographical marker system 100 of FIG. 1A, according to a preferred embodiment of the present invention. Cylindrical container 502 has a flat central bottom surface 516.

Figure 5C:
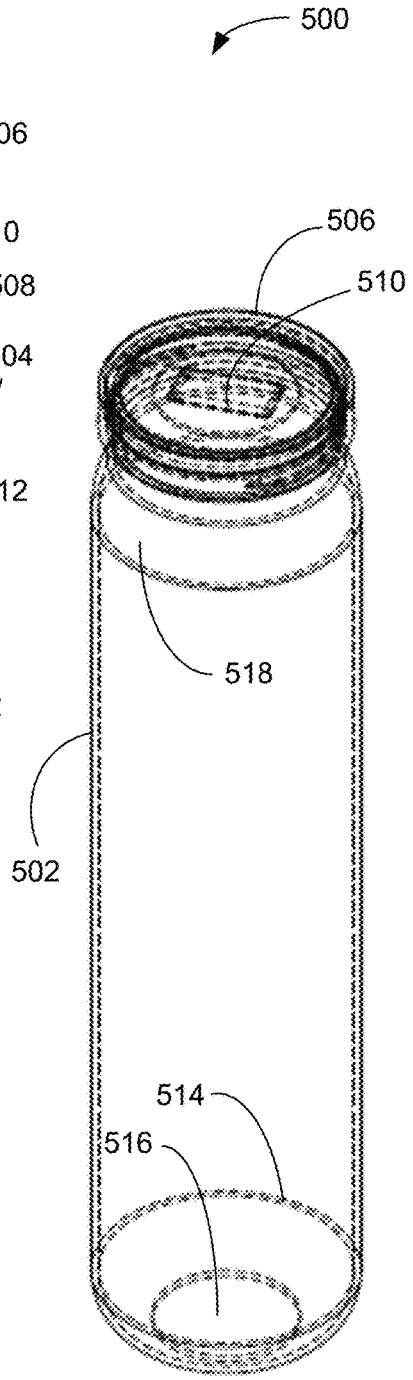
FIG. 5C is a side perspective wire frame view illustrating the second exemplary embodiment of the cylindrical container of the exemplary embodiment of the geographical marker system of FIG. 1A, according to a preferred embodiment of the present invention.

FIG. 5C is a side perspective wire frame view illustrating the second exemplary embodiment of the cylindrical container 502 of the exemplary embodiment of the geographical marker system 100 of FIG. 1A, according to a preferred embodiment of the present invention. The flat central bottom surface 516 can be better seen in this view.

FIG. 5D is a top wire frame view illustrating the second exemplary embodiment of the cylindrical container 502 of the exemplary embodiment of the geographical marker system 100 of FIG. 1A, according to a preferred embodiment of the present invention. Passive communication chip 510 rests on a non-metallic portion 520 of the seal 508.

Figure 5E:
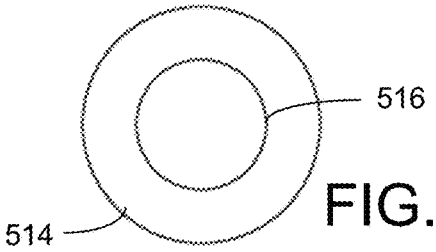
FIG. 5E is a bottom plan view illustrating the second exemplary embodiment of the cylindrical container of the exemplary embodiment of the geographical marker system of FIG. 1A, according to a preferred embodiment of the present invention.

FIG. 5E is a bottom plan view illustrating the second exemplary embodiment of the cylindrical container 502 of the exemplary embodiment of the geographical marker system 100 of FIG. 1A, according to a preferred embodiment of the present invention. The flat bottom 516 rests upon cruciform support 208 within housing 102 (see FIGS. 6A-6D).

Figure 6B:
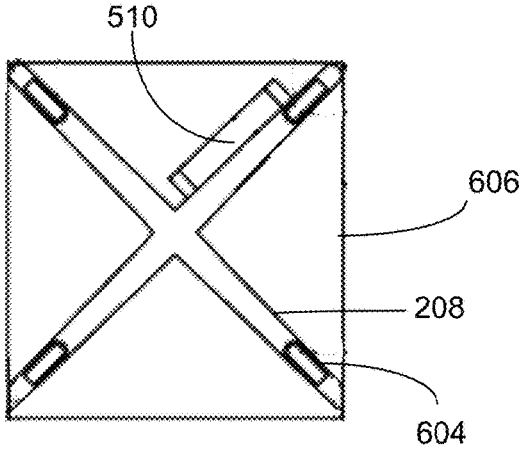
FIG. 6B is a top plan view illustrating the cruciform support of the exemplary embodiment of the geographical marker system of FIG. 1A, according to a preferred embodiment of the present invention.
Figure 6C:
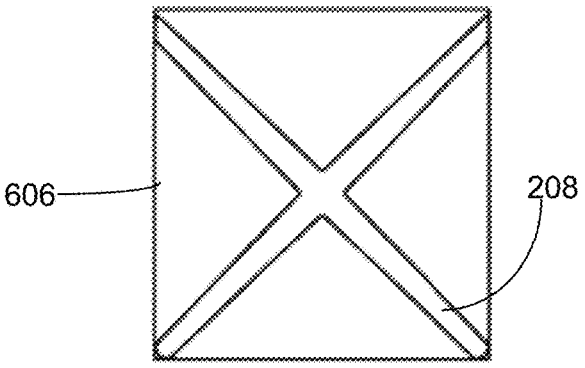
FIG. 6C is a bottom plan view illustrating the cruciform support of the exemplary embodiment of the geographical marker system of FIG. 1A, according to a preferred embodiment of the present invention.
Figure 6A:
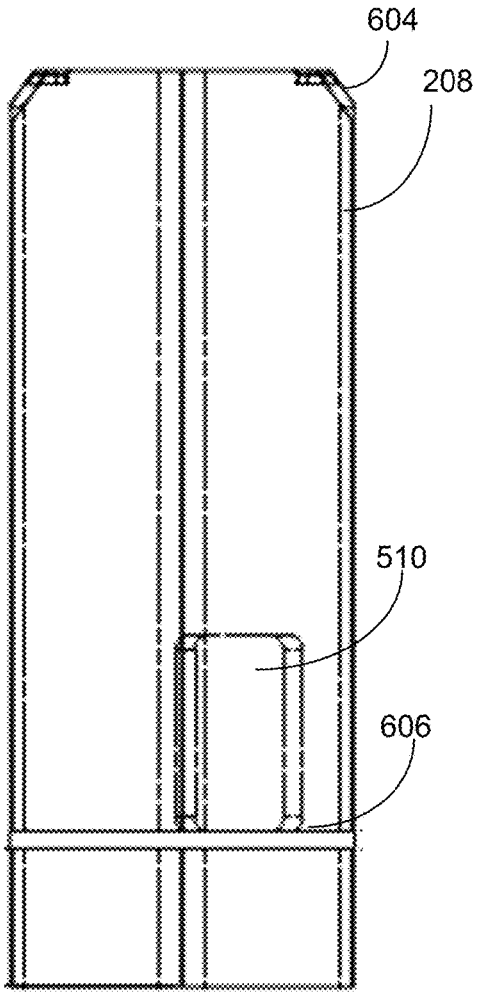
FIG. 6A is a side elevation view illustrating an exemplary embodiment of a cruciform support of the exemplary embodiment of the geographical marker system of FIG. 1A, according to a preferred embodiment of the present invention.

FIG. 6A is a side elevation view illustrating an exemplary embodiment of a cruciform support 208 of the exemplary embodiment of the geographical marker system 100 of FIG. 1A, according to a preferred embodiment of the present invention. The top outer corners of the four wings of the cruciform support 208 are beveled 604. Triangular horizontal support panels 606 (one labeled of two visible of four) brace the four wings apart, two by two. Passive communications chip 510 is shown in an alternate location on a triangular horizontal support panel 606.

FIG. 6B is a top plan view illustrating the cruciform support 208 of the exemplary embodiment of the geographical marker system 100 of FIG. 1, according to a preferred embodiment of the present invention. Passive communications chip 510 is shown also secured to a wing of the cruciform support 208.

FIG. 6C is a bottom plan view illustrating the cruciform support 208 of the exemplary embodiment of the geographical marker system 100 of FIG. 1, according to a preferred embodiment of the present invention. Triangular horizontal support panels 606 (one labeled of four) can be best seen in this view.

Figure 6D:
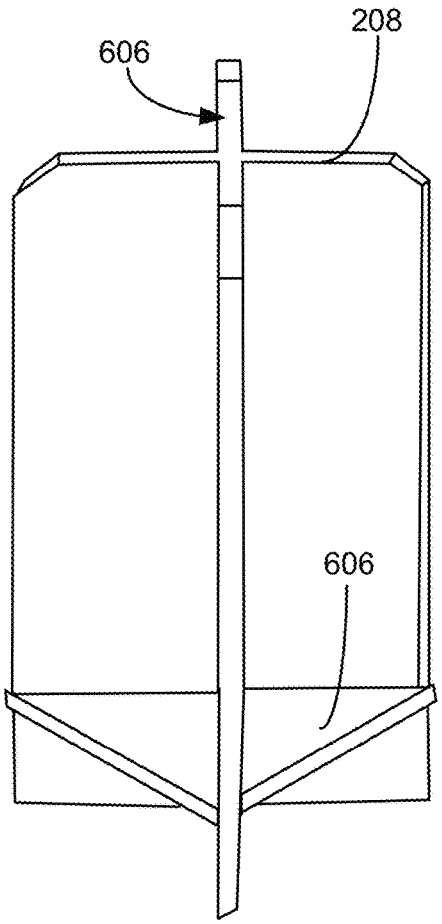
FIG. 6D is a perspective view illustrating the cruciform support of the exemplary embodiment of the geographical marker system of FIG. 1A, according to a preferred embodiment of the present invention.

FIG. 6D is a perspective view illustrating the cruciform support of the exemplary embodiment of the geographical marker system of FIG. 1, according to a preferred embodiment of the present invention. Top surface 606 of cruciform support 208 supports the cylindrical container 220 or 502.

Figure 7:
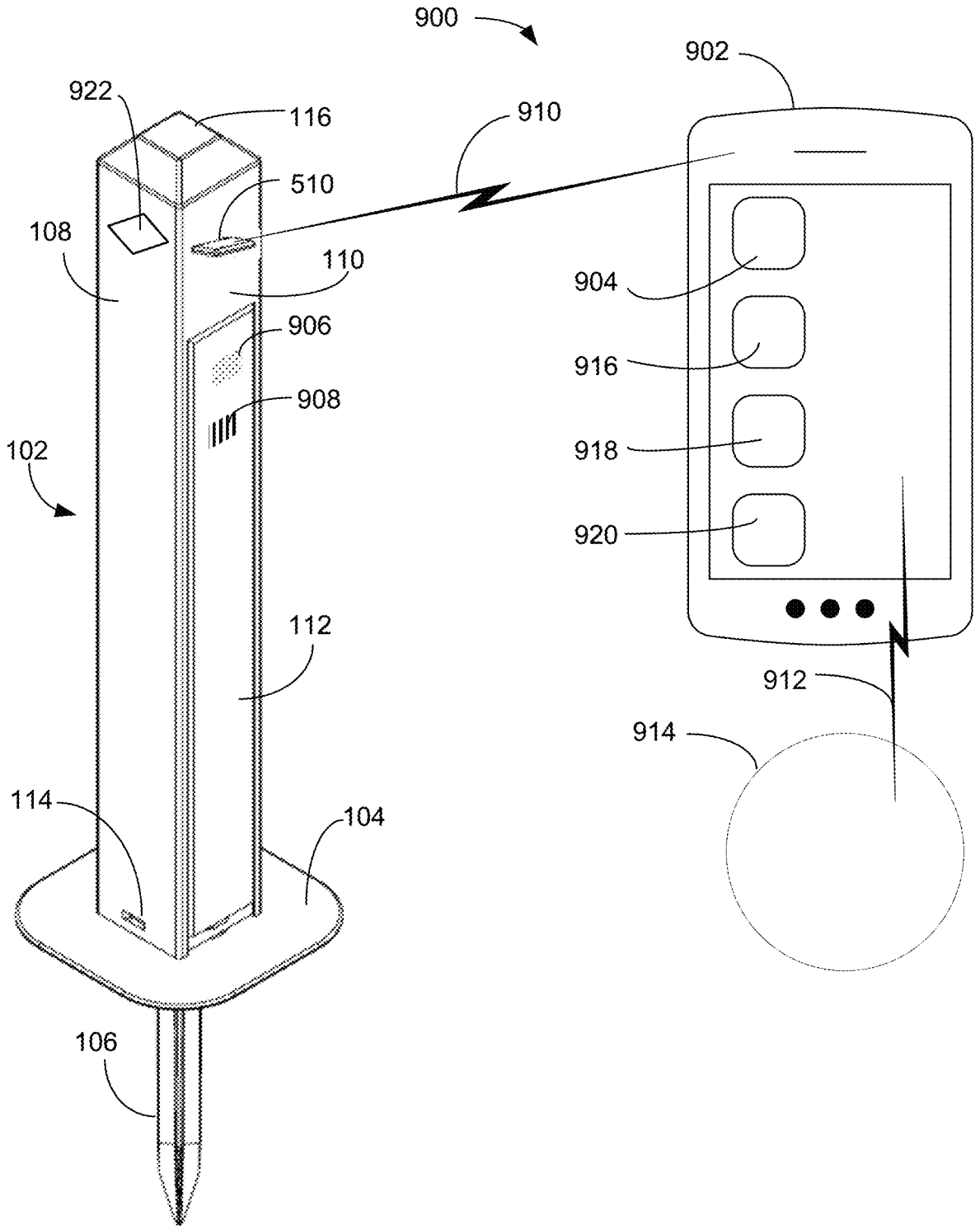
FIG. 7 is a diagrammatic view illustrating exemplary electronic communications of the exemplary embodiment of the geographical marker system of FIG. 1A, according to a preferred embodiment of the present invention.

FIG. 7 is a diagrammatic view illustrating exemplary electronic communications 900 of the exemplary embodiment of the geographical marker system of FIG. 1A, according to a preferred embodiment of the present invention. A remote electronic communications device 902 is illustrated as a smart cellular telephone 902 as a non-limiting example. Remote electronic communications device 902 has a specialized application 904 for interrogating passive communication chip 510 and receiving information therefrom. The information retrieved may lead to additional information sources, such as an internet web page or a database within the specialized application 904. The electronic communications device 902 has an application 916 for reading QR codes such as QR code 906 and to connect to an informational and/or interactive web page via the internet 914.

Electronic communications device 902 has an internet browser application 918 which can accept a URL such as URL 908 and connect to an informational and/or interactive web page on the internet 914. Application 920 is specialized for communication with an active communications device 922 within the housing 102. In some embodiments, application 920 may be included in specialized application 904.

The following claims include some functional claiming and contain no statements of intended use.

The invention claimed is:

1. A geographical marker system comprising:

a geographical marker comprising:

a base plate having a top surface and a bottom surface;

an anchor extending downwardly from the bottom surface of said base plate;

a support extending upwardly from the top surface of the base plate configured to stably support a sealable container, wherein the sealable container is configured to be filled by a user;

vertically extending housing that detachably couples to the base and encompasses the sealable container when the sealable container is supported on the support, wherein the housing has at least one substantially planar exterior surface configured to releasably receive a snap in panel; and vii. a communication chip that is coupled to or housed within said housing configured to communicate with an external remote electronic communications device.

2. The geographical marker system of claim 1, wherein said housing is a radio-frequency-transparent housing.

3. The geographical marker system of claim 2, wherein said communication chip is operable to communicate information associated with a purpose of said geographical marker and comprises one of a passive radio-frequency chip within said housing and an active radio-frequency chip within said housing.

4. The geographical marker system of claim 3, wherein one of:

said passive radio-frequency chip within said housing is further within said sealable container; and said active radio-frequency chip within said housing is further within said sealable container.

5. The geographical marker system of claim 2, wherein said communication chip comprises one of a QR code and a URL displayed on either at least one of the at least one substantially planar exterior surfaces of said housing and at least one snap-in panel.

6. The geographical marker system of claim 1, wherein said remote external electronic communications device includes at least one of:

an application capable of communicating with a passive radio-frequency chip within said housing;

an application capable of communicating with an active radio-frequency chip within said housing;

an application capable of reading a QR code and linking to data on the Internet containing information associated with a purpose of said geographical marker; and an application capable of receiving a user's input of an URL to link to data on the Internet containing information associated with a purpose of said geographical marker.

7. The geographical marker system of claim 6, wherein two or more said applications may be combined in one application.

8. The geographical marker system of claim 6, wherein said QR code is a link to a website on the Internet.

9. The geographical marker system of claim 1, the support is a first cruciform support providing structural support for said housing and supporting said sealable container.

10. The geographical marker system of claim 1, comprising a releasably attached cap closure on the housing with a second cruciform support in said cap.

11. A geographical marker system comprising:

a base plate having a top surface and a bottom surface a housing vertically extending from and releasably fastened to the base plate and having a height and at least one substantially planar exterior surface configured to receive at least one snap-in panel;

an anchor extending downwardly from a bottom surface of said base plate;

a releasably attached cap closure at a top end of said housing;

a sealable container supported by said base plate within said housing, wherein the sealable container is configured to be filled by a user; and at least one snap-in panel releasably attachable to at least one of said at least one substantially planar exterior surface of said housing.

12. The geographical marker system of claim 11, wherein the housing has a first wall and a second wall opposite the first wall, the system further comprising a support that supports and secures the sealable container within the housing, the support extending along at least a portion of the height of the housing and spans between the first wall and the second wall.

13. The geographical marker system of claim 12, wherein the support comprises a center and at least one wing that extends from the center to the first wall and the second wall.

14. The geographical marker system of claim 12, wherein the support comprises a base support and a cap support that secures the container in place within the housing and supports the structural stability of the housing.

15. The geographical marker system of claim 11, wherein a combined height of the support and the container equals the height of the housing.

16. A geographical marker system comprising:

a geographical marker comprising:

a base plate having a top surface and a bottom surface;

a radio-frequency-transparent housing vertically extending from and releasably fastened to the bottom surface and having at least one substantially planar exterior surface configured to receive at least one snap-in panel;

a spike extending downwardly from the bottom surface of said base plate;

a releasably attachable cap closure at a top end of said housing;

a sealable container supportable within said housing, wherein the sealable container is configured to be filled by a user;

at least one snap-in panel releasably coupled to the at least one substantially planar exterior surface of said housing; and a communication chip that is one of within said housing and on said housing and is configured to communicate with an external remote electronic communications device.

17. The geographical marker system of claim 16, wherein said communication chip is operable to communicate information associated with a purpose of said geographical marker and comprises one of a passive radio-frequency chip within said housing and an active radio-frequency chip within said housing.

18. The geographical marker system of claim 17, wherein one of:

said passive radio-frequency chip within said housing is further within said cylindrical container; and said active radio-frequency chip within said housing is further within said cylindrical container.

19. The geographical marker system of claim 16, wherein said remote external electronic communications device:

includes at least one of:

an application capable of communicating with a passive radio-frequency chip within said housing;

an application capable of communicating with an active radio-frequency chip within said housing;

an application capable of reading a QR code and linking to data on the Internet containing information associated with a purpose of said geographical marker; and an application capable of receiving a user's input of a URL to link to data on the Internet containing information associated with a purpose of said geographical marker;

wherein two or more said applications may be combined into one application; and wherein said links comprise links to websites on the Internet.

20. The geographical marker system of claim 15, wherein the container and the support combined define an internal structure and wherein the container comprises an external surface that spans between the first wall and the second wall such that the structure of the housing is strengthened throughout the height of the housing by the internal structural spanning between the first wall and the second wall for the entire height of the housing.

* * * * *